US006446307B2

(12) United States Patent
Wilkins

(10) Patent No.: US 6,446,307 B2
(45) **Date of Patent: *Sep. 10, 2002**

(54) MANWAY LID LIFTER

(75) Inventor: Larry C. Wilkins, Georgetown, IN (US)

(73) Assignee: Electromechanical Research Laboratories, Inc., New Albany, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/255,289

(22) Filed: Feb. 22, 1999

(51) Int. Cl.[7] ..... E05D 11/10; E05D 7/06; E02D 29/14; B65D 41/02; E06B 11/00

(52) U.S. Cl. ..... 16/325; 404/25; 220/260; 49/33; 49/237

(58) Field of Search ..... 16/325, 308; 220/260; 404/25; 49/33, 237, 238, 242, 379, 428

(56) References Cited

U.S. PATENT DOCUMENTS

| | | | | |
|---|---|---|---|---|
| 736,714 A | | 8/1903 | Gendron | 16/401 |
| 823,372 A | | 6/1906 | Walcott | 16/49 |
| 1,801,840 A | | 4/1931 | Banfield | 16/80 |
| 2,587,287 A | | 2/1952 | Chamberlain | 16/72 |
| 3,665,958 A | * | 5/1972 | Dunkelis | 137/522 |
| 3,712,248 A | | 1/1973 | Floehr | 105/253 |
| 3,714,680 A | | 2/1973 | Little | 16/290 |
| 3,744,670 A | * | 7/1973 | De Frees | 220/314 |
| 4,137,669 A | | 2/1979 | Nunlist | 49/386 |
| 4,173,909 A | * | 11/1979 | Cleveland et al. | |
| 4,372,461 A | * | 2/1983 | Lerman et al. | 220/260 |
| 4,534,132 A | | 8/1985 | Smith | 49/386 |
| 4,537,233 A | | 8/1985 | Vroonland et al. | 141/387 |
| 4,828,236 A | | 5/1989 | Inoue | 267/182 |
| 4,840,514 A | * | 6/1989 | Defrance et al. | 404/25 |
| 4,881,432 A | * | 11/1989 | Olorenshaw et al. | |
| 4,978,103 A | * | 12/1990 | Moisan | |
| 5,037,231 A | | 8/1991 | Kitamura | 403/120 |
| 5,038,520 A | * | 8/1991 | Amorese et al. | 49/386 |
| 5,136,811 A | | 8/1992 | Lyons, Sr. | 49/386 |
| 5,184,422 A | | 2/1993 | Wade et al. | 49/239 |
| 5,292,107 A | * | 3/1994 | Chick | |
| 5,394,650 A | | 3/1995 | Dean | 49/386 |
| 5,507,590 A | * | 4/1996 | Argandona | 404/25 |
| 5,788,406 A | * | 8/1998 | Hernandez | 404/25 |

FOREIGN PATENT DOCUMENTS

| | | | |
|---|---|---|---|
| FR | 2 627 468 A | * | 8/1989 |
| GB | 2 163 467 A | * | 2/1986 |

OTHER PUBLICATIONS

Catalog entitled "Deck Hardware & Winches" by Timco Industries, Inc. of New Albany, IN, Catalog, pp. 61, 63–65 (Cen–Tex Brand Hatches).

* cited by examiner

*Primary Examiner*—Lynne H. Browne
*Assistant Examiner*—Vishal Patel
(74) *Attorney, Agent, or Firm*—Woodard, Emhardt, Naughton Moriarty & McNett

(57) ABSTRACT

A lid lifter mount is installed on the hinge pin of a conventional manway lid, and has a compression spring assembly engaging a lever which is also installed on the hinge pin. The lever has a bar engaging a lid hinge arm. A spring force adjustment screw connected to the mount enables adjustment of the amount of lift assist the bar applies to the hinge arm by cam action against the arm as the operator lifts the lid. Two embodiments are shown for attachment to two types of lid hinges.

27 Claims, 12 Drawing Sheets

MANWAY LID LIFTER

BACKGROUND OF THE INVENTION

This invention relates generally to manhole or manway covers, and more particularly to a device to assist in the lifting of such cover.

Because of the weight of manway lids, various efforts have been made to make it easier to open them. Usually such devices are associated with the lid hinge assembly. U.S. Pat. Nos. 4,137,669 and 5,038,520 use conical compression springs pulling a rod to assist. U.S. Pat. No. 5,184,422 also uses a compression spring, but vertically oriented to assist the limited distance left of a lid which swings away from the manway in a horizontal plane. U.S. Pat. No. 5,394,650 uses torsion springs around a horizontal hinge pin to assist the lid lifting. Spring balanced lids have been available in the marine industry for at least twenty years. A variety of Cen-Tex brand hatches with spring-assisted lids is available from Timco Industries, Inc. of New Albany, Ind. These use torsion springs to balance round, rectangular, and elongate oval shapes of lids. Some aspects of inconvenience in the mounting or use of one or more of these devices are the necessity of attaching one or more components of the balancing assembly to the manway frame or cover, the inability to hold the cover open adequately, the inability or difficulty in adjusting the balancing force to prevent the cover from dropping, and the necessity to use welding equipment for some installations to manway frames. The difficulty of adapting the balancing assembly to various styles of covers and arrangements of hinging the cover to the manway frame has been an ongoing problem.

SUMMARY OF THE INVENTION

Described briefly, according to a typical embodiment of the present invention, a balancer mount is connected to the manway hinge and engages the manway frame to locate the lifter assembly. A cam is situated in the mount for pivotal action on the hinge and has a portion to engage the lid, and a portion to receive a force applied by a balancing spring seated in the mount. A spring adjustment device is provided at a readily accessible location on the mount.

In one embodiment, the lid lifter assembly is arranged to provide the lid lifting assist at a location between the hinge arms of the lid. In another embodiment, the lifter assembly is mounted outboard of the hinge arms and applies the lift assist at a location outboard of the hinge arms but adjacent one of the hinge arms. In both instances, the lifter assembly has a housing with at least one arm portion engaging the lid hinge mounting bracket of the manway to hold and control the lifter assembly housing relative to the manway.

DESCRIPTION OF THE PREFERRED EMBODIMENT

Figure 1:
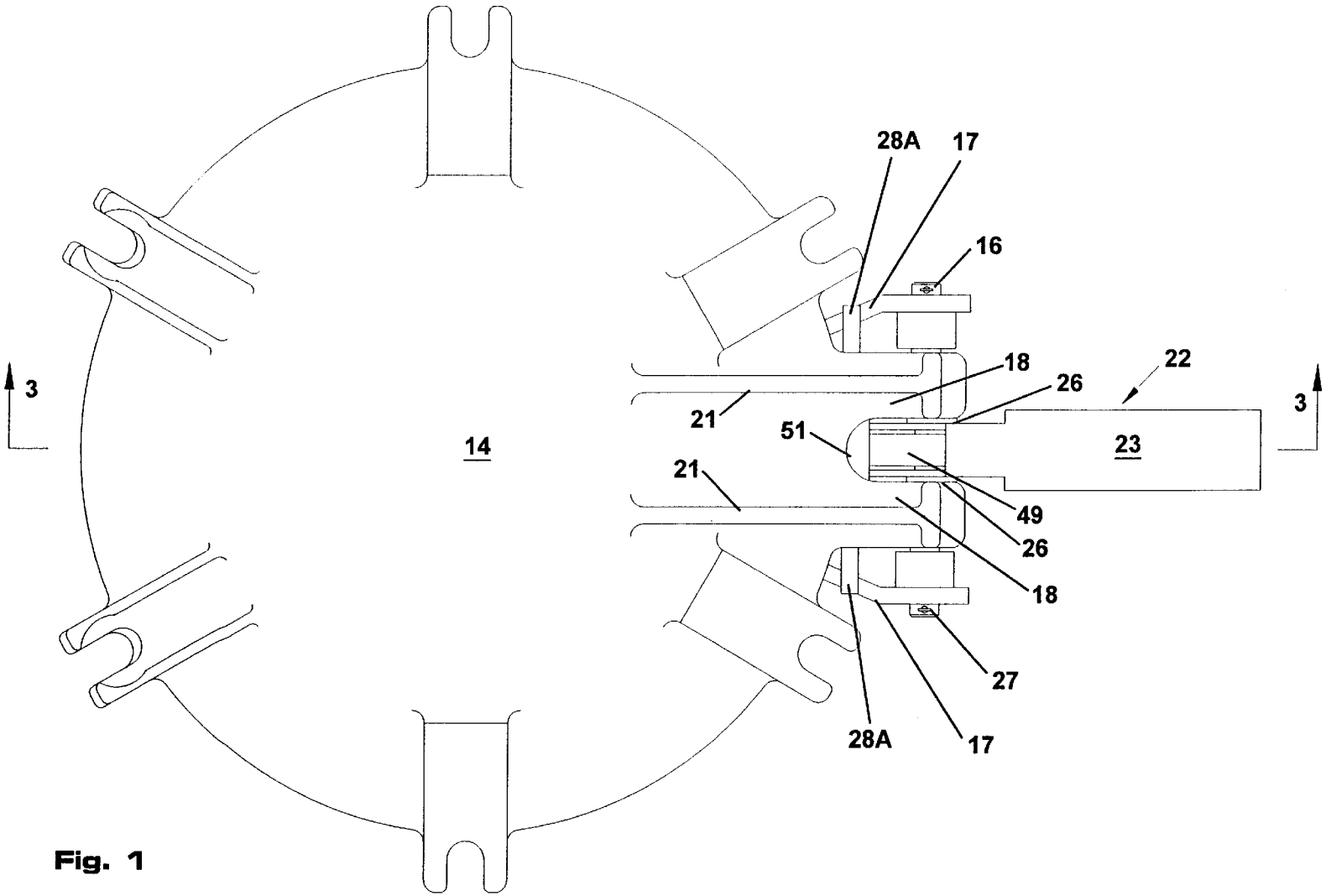
FIG. 1 is a top plan view of a manway/lid assembly with the lid lifter assembly mounted thereto.
Figure 2:
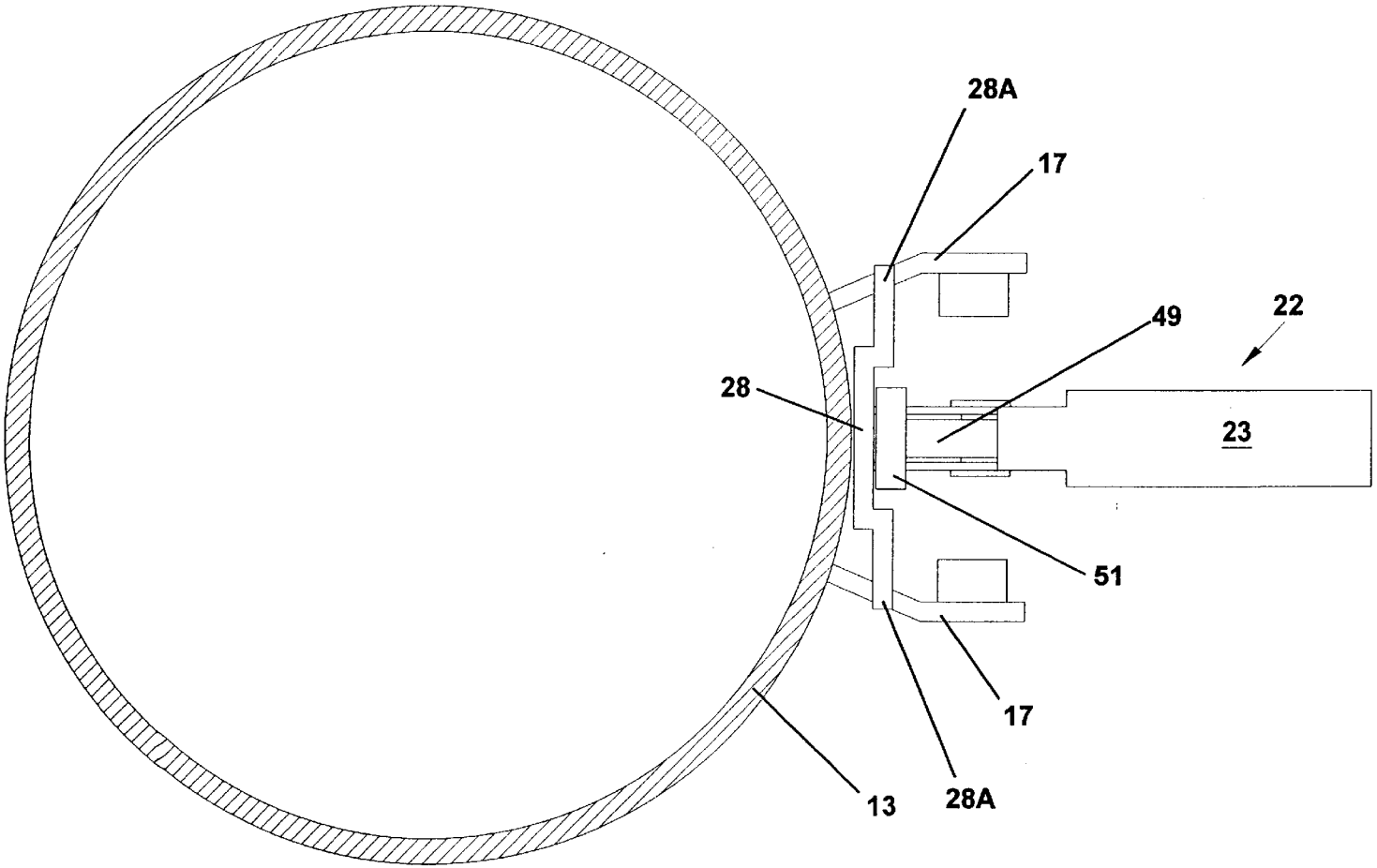
FIG. 2 is a bottom plan view showing only the manway frame, hinge mounting brackets and the lifter assembly.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, and particularly FIGS. 1–6, the manway assembly 11 is mounted to the top of a compartment 12 (shown only fragmentarily and not in section) of a marine vessel, railroad tank car, or stationery installation, for example. It includes the frame 13 which is normally welded in place on the compartment, and a lid 14 connected by a hinge pin 16 to a couple of brackets 17 welded to the frame 13. This is a fairly conventional type of installation. In the illustrated embodiment, the hinge arm portion 18 of the lid has a slot 19 therein and has a couple of buttresses 21 to strengthen the lid at the hinge mounting arms.

According to this first embodiment of the present invention, a mount for the lid lifter assembly 22 is connected to the hinge pin 16 and has a portion engaging the manway frame to position and stabilize the mount. While the mount may have different forms, the illustrated example includes a downwardly-opening U-shaped channel 23 having apertures 24 therein receiving flanged bushings 26 through which the hinge bolt 16 extends. A cotter pin 27 at each end retains the hinge pin in the assembly as shown in FIG. 1. The U-channel 23 has a stop plate 28 affixed by welding or otherwise to the front end 29 of the channel. The stop plate 28 has laterally extending arms 28A bearing on brackets 17. The U-channel 23 also has a door clip 31 fixed to the bottom edges 32 by welding, and a door 36 whose lower edge is received within the door clip. The door extends upwardly along the rear edges 37 of the channel to the top 38 where it is fastened by a screw to a spring adjustment block 39 welded in the top of the U-channel. A spring adjustment screw 41 is threaded into block 39 and has a lower end received in a top retainer 42 for a compression spring 43 whose lower end is received on the spring bottom retainer 44. The spring bottom retainer is connected by a threaded stud 46 to the upper end of a yoke member 47, whose lower end is pinned in aperture 48 at one end of a cam 49, which has an aperture 50 pivotally mounted on the bushings 26 received on the hinge pin 16 whereby the cam is rockably mounted to the hinge pin 16. The opposite end of the cam 49 has a bar 51 affixed thereto and which is engageable with the lower edges 52 of arms 18. Thus, the compression spring is in position to act along axis 55 and urge the cam in a clockwise direction (FIG. 3) to operate as a first class lever to cam the lid in an opening direction of arrow 56.

The lid lifter according to the present invention can be mounted to a variety of conventional manway and lid assemblies, by simply removing the hinge pin, putting the mount and cam in place and re-installing the hinge pin through the cam and mount and the lid and manway hinge apertures. Then the amount of assist can be adjusted by simply turning the screw at the top to compress the spring as desired. No special tools or techniques are needed. No fastener (other than the binge pin) or welding, is required.

Figure 10:
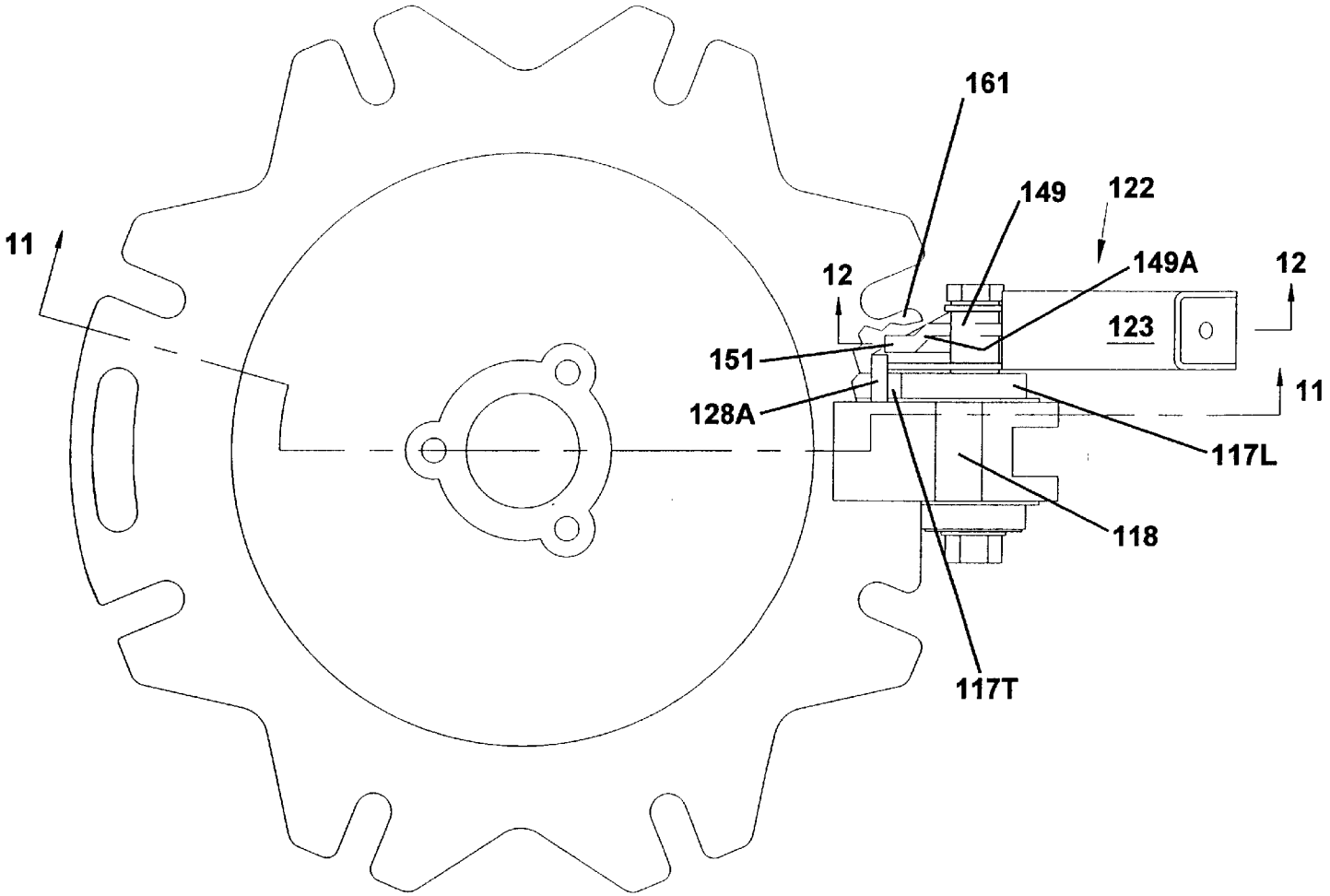
FIG. 10 is a top plan view thereof, with a portion of the manway lid broken away to show the location of the cam relative to the lid.
Figure 11:
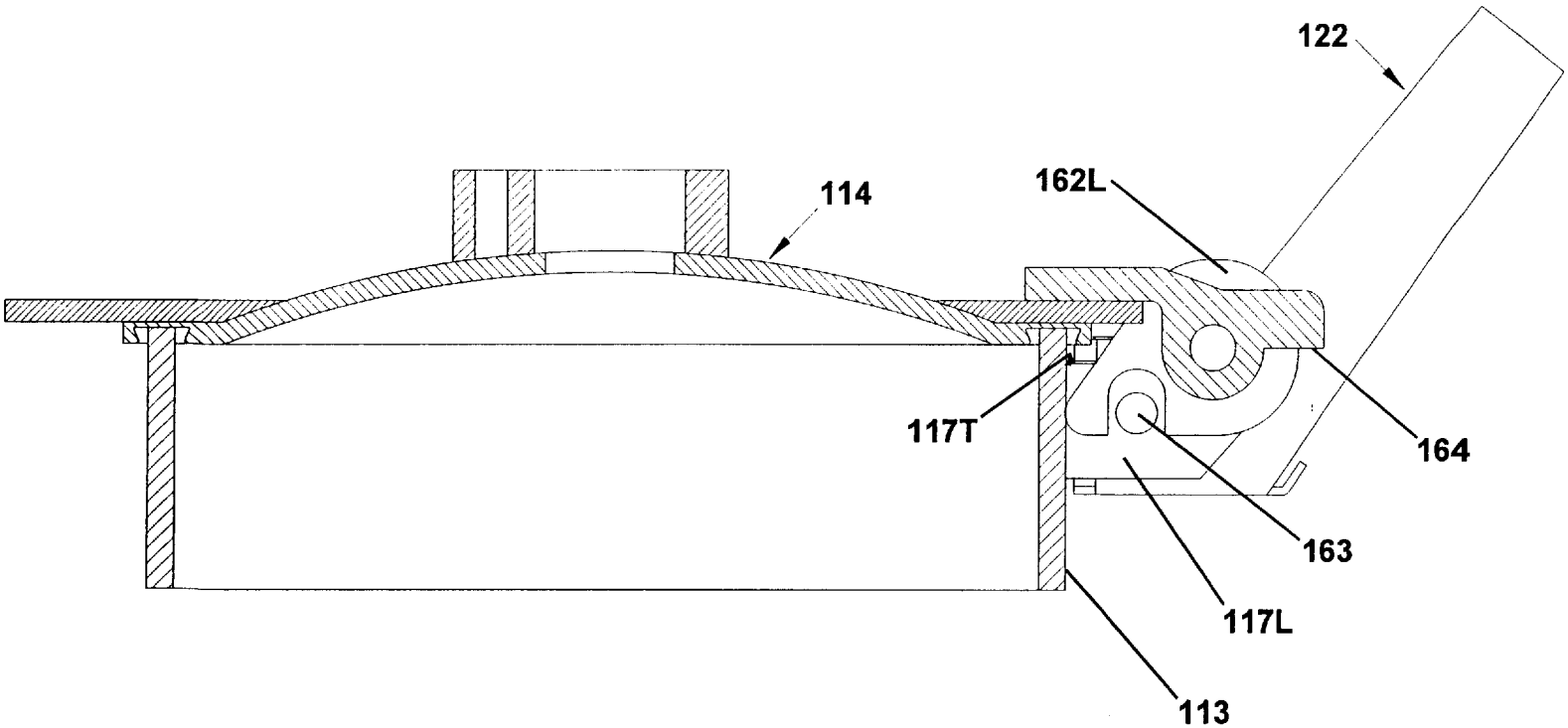
FIG. 11 is a section therethrough taken at line 11—11 in FIG. 10 and viewed in the direction of the arrows.

To demonstrate the adaptability to another type of conventional manway and lid assembly, FIGS. 7–12 are provided and will be described now. In these figures, components having the same or similar characteristics in the description of the first embodiment will be given the same reference numerals, where convenient, but with the additional digit "1". Accordingly, the lifter assembly 122 is provided to assist the person to lift the lid assembly 114 which is pivotally mounted by the hinge 116 to the manway brackets 117 fixed on the manway frame 113 as by welding, for example. But in this manway assembly, the lid has only a single hinge arm 118 pivotally mounted on the hinge bolt 116, rather than the arm 18 slotted at 19 in the manway assembly of FIGS. 1–4. Therefore, the lift assembly according to FIGS. 1–6 cannot be mounted in the plane of the centerline of the manway assembly 113/114. Instead, this alternate embodiment 122 is mounted outboard of bracket 117L as best shown in FIG. 10. For that purpose, the inverted U-channel 123 is provided with a stop plate 128 only on the channel wall 123N that is adjacent the bracket 117L. The arm 128A extends laterally from the plate 128 affixed to the front edge 129 of channel wall 123N, and is positioned to bear downward on the top 117T (FIGS. 9 and 11) of bracket 117L when the lift assembly 122 is mounted on the hinge pin 116. Similar to the relationship shown in FIG. 3 for the first embodiment, the plate 128 of the alternate embodiment is positioned immediately adjacent the wall of frame 113. The bracket engaging arms 28A and 128A prevent the spring force from turning the housing counterclockwise under load.

Figure 12:
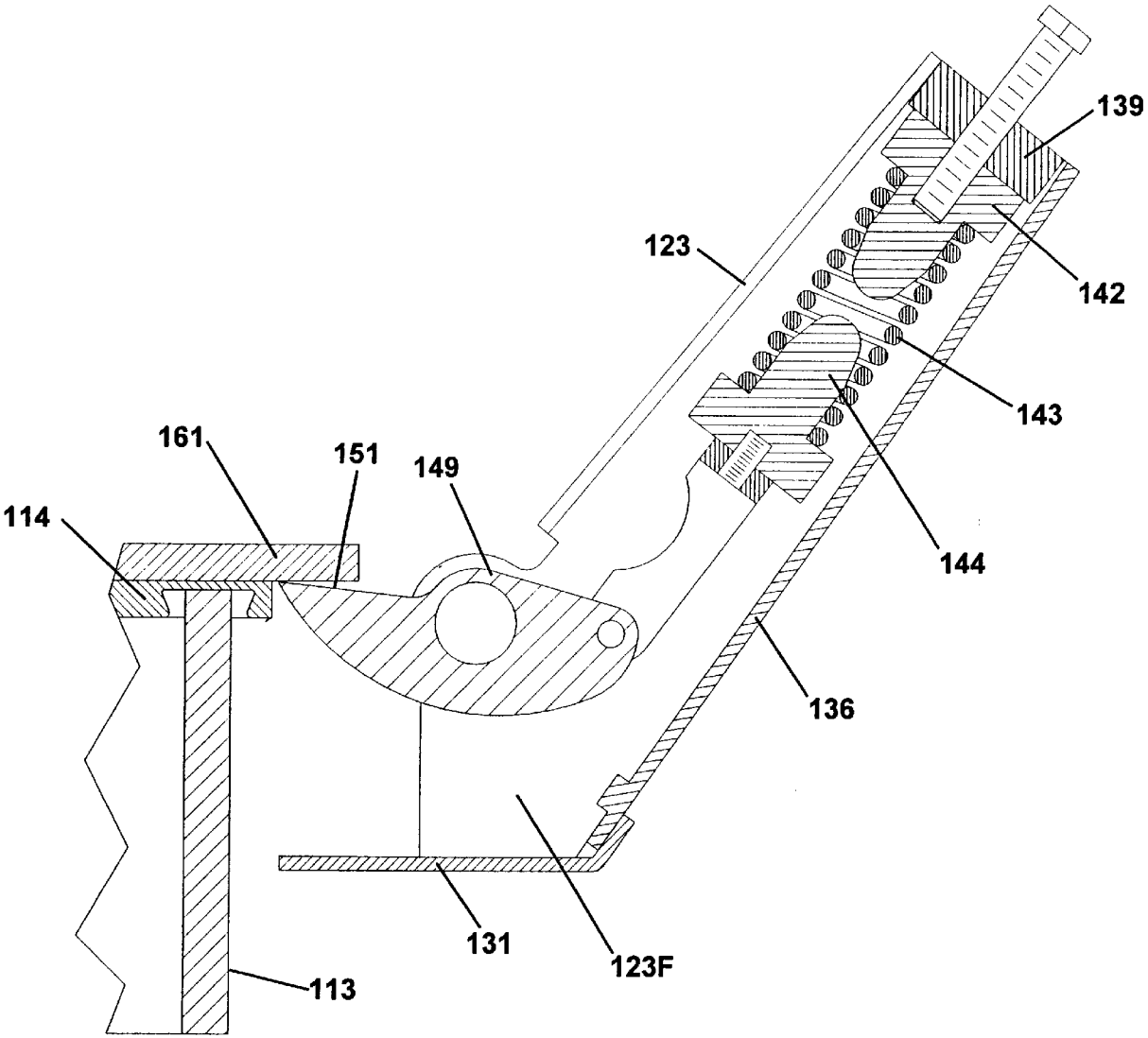
FIG. 12 is an enlarged fragmentary section through the lifter assembly taken at 12—12 in FIG. 10 and viewed in the direction of the arrows.

Because of the offset location of the lift assembly 122 with respect to the center line of the manway assembly, the lid contacting portion of the cam 149 has a horizontal offset at 149A which brings the lid-contacting top portion 151 of the cam closer to the center of the lid hinge arm 118. Thus, portion 151 is clearly under the tab 161 at one side of the lid hold-down bolt slot adjacent the hinge arm 118, whereby the cam portion 151 is able to engage the tab for lifting, as best shown in FIG. 12.

A few additional differences between the second embodiment and the first embodiment may be noted, such as the shape of the bottom plate 131, considering the different lengths of the walls 123N and 123F of the U-channel 123. Another is the notch 123F in the front of the wall 123N and the notched washers 162 shown in FIG. 9 to accommodate the lid stop rod 163 normally found in this particular style of manway/lid assembly and which is in position to engage the underside 164 of the hinge arm 118 to provide a stop when the lid of the conventional lid assembly is opened. With the lifter assembly of the present invention, the stop and rod 163 are not required, as the spring adjusting screw 141 can be adjusted to hold the lid open at a 60° angle from the closed position, and it is not necessary to lift the lid all the way back to the stop. Of course, for those users who would be inclined to open the lid as far as it would go, the stop rod 163 and hinge abutment 164 are beneficial.

Apart from the differences and some details described specifically above, the other features of the lift assembly can be identical to those described above for the first embodiment. These include the door 136, the spring adjustment block 139, the spring adjustment screw 141, top retainer 142, compression spring 143, bottom retainer 144, threaded stud 146, yoke member 147 and pin 148. The arrangement of the spring 143 and adjusting screw 141, spring rate, dimensions from pivot pin axis to the axis of connector pin 148, and the contact point of bar 51 in the first embodiment or cam top 151 in the second embodiment with the lid, can be determined based upon the size and weight of the lid, the amount of lift assist desired, and the angle of the lifter assembly load applying axis 55 extending through aperture 48, relative to horizontal. Good lift assistance consistent with size and space requirements of the lift assembly according to the present invention can be achieved with an angle of axis 55 up from horizontal at 53°.

Figure 3:
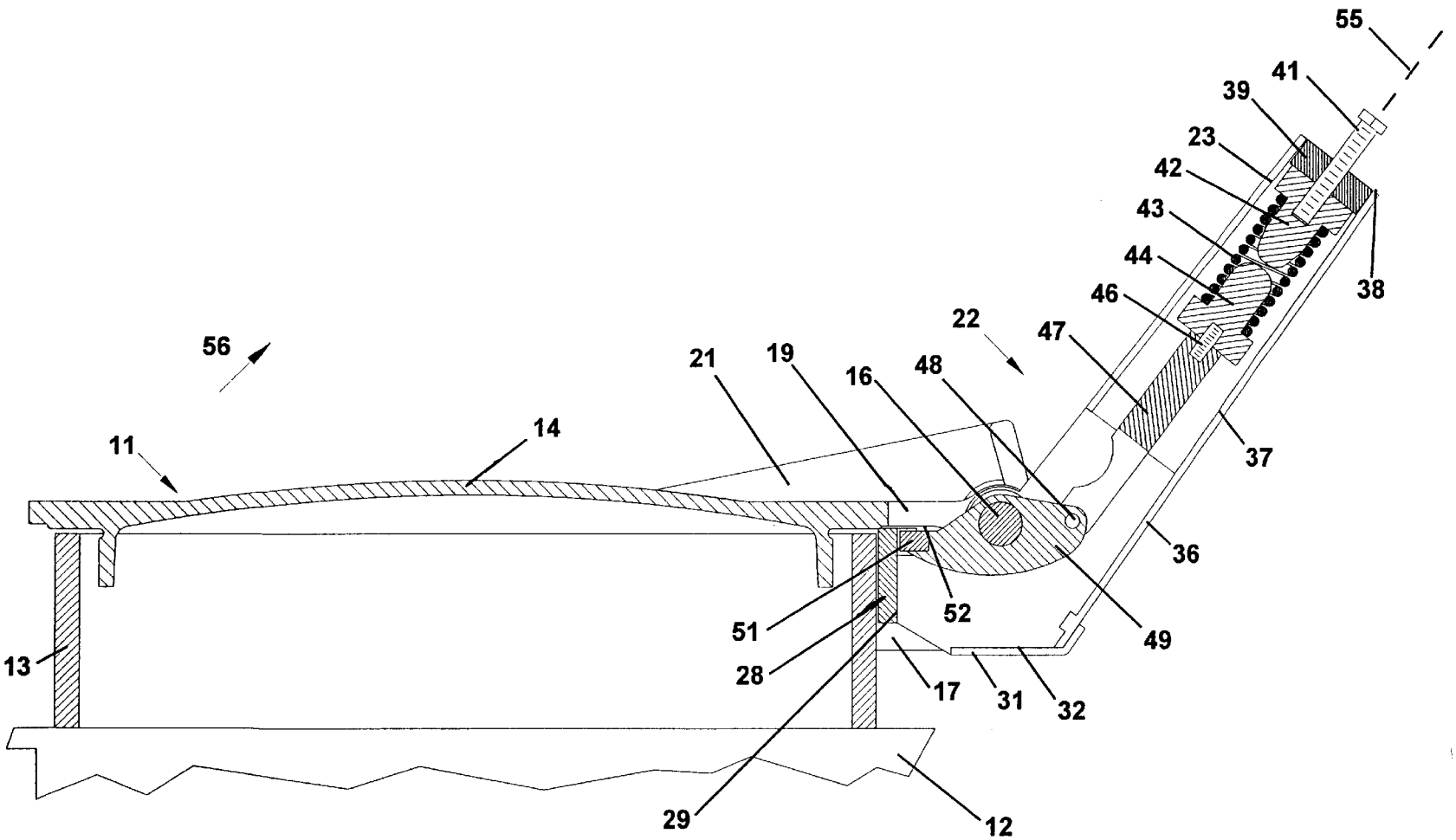
FIG. 3 is a section through the assembly of FIG. 1 taken at line 3—3 in FIG. 1 and viewed in the direction of the arrows.
Figure 4:
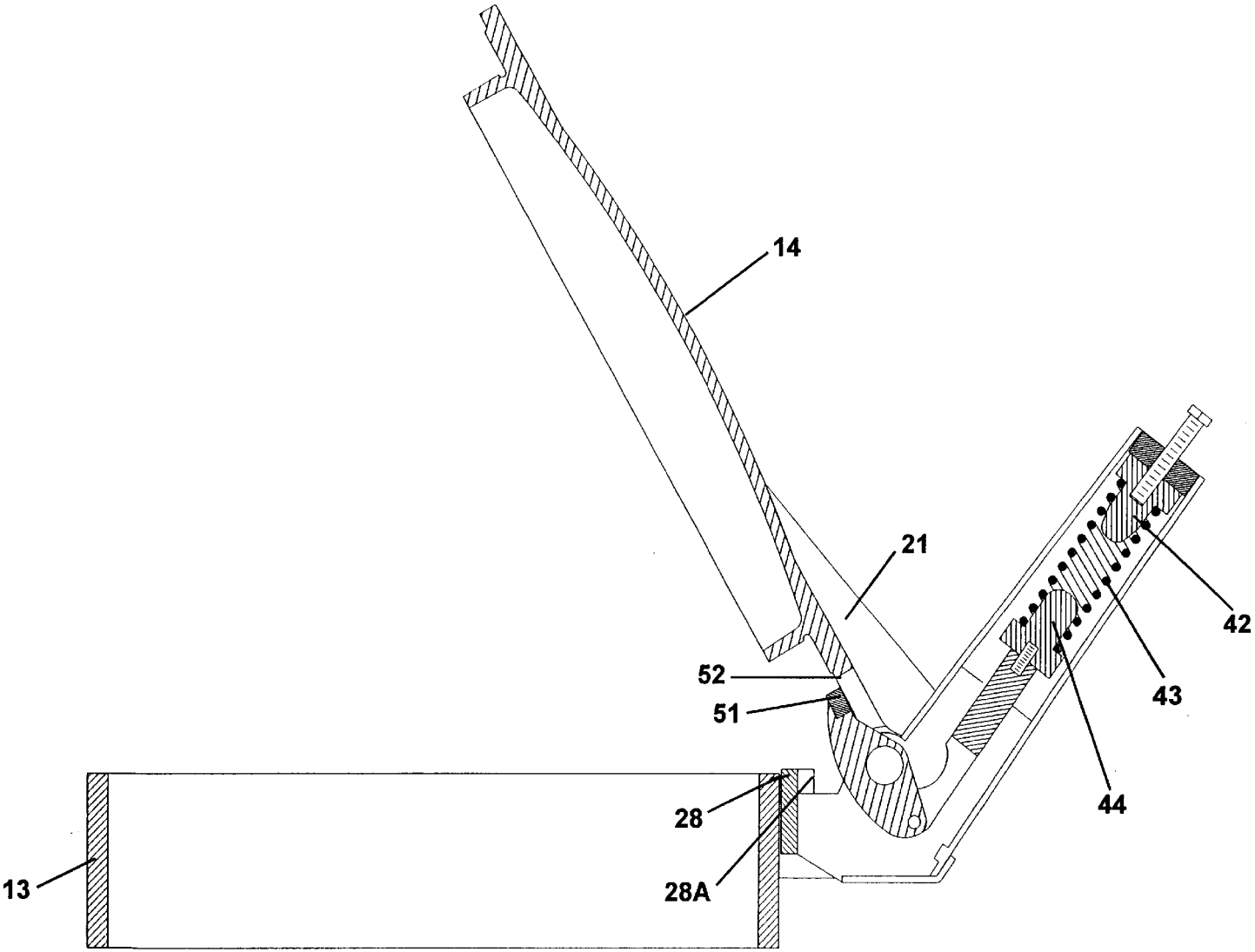
FIG. 4 is a section like FIG. 3 but showing the lid in the open and neutral balanced position.
Figure 5:
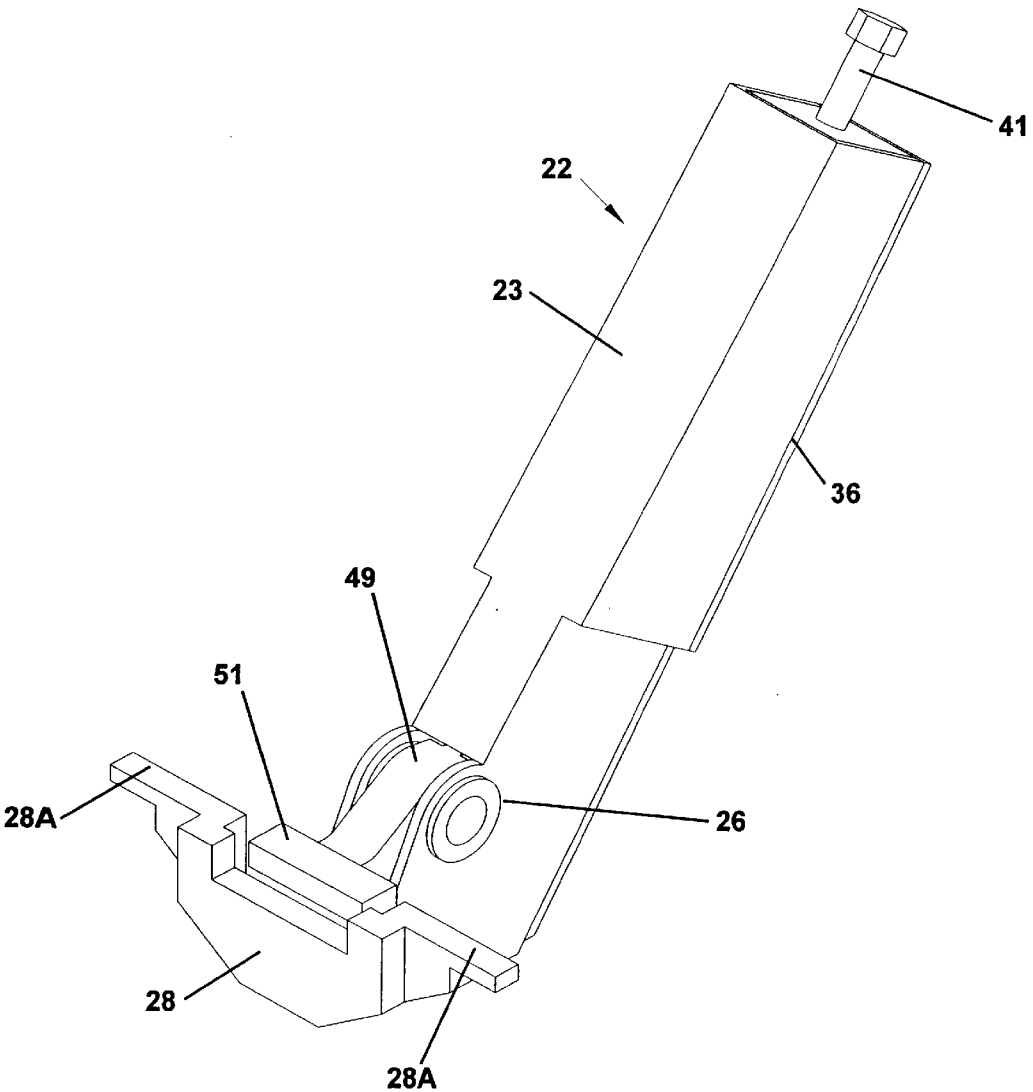
FIG. 5 is a pictorial view of the lifter assembly separate from the manway assembly.
Figure 6:
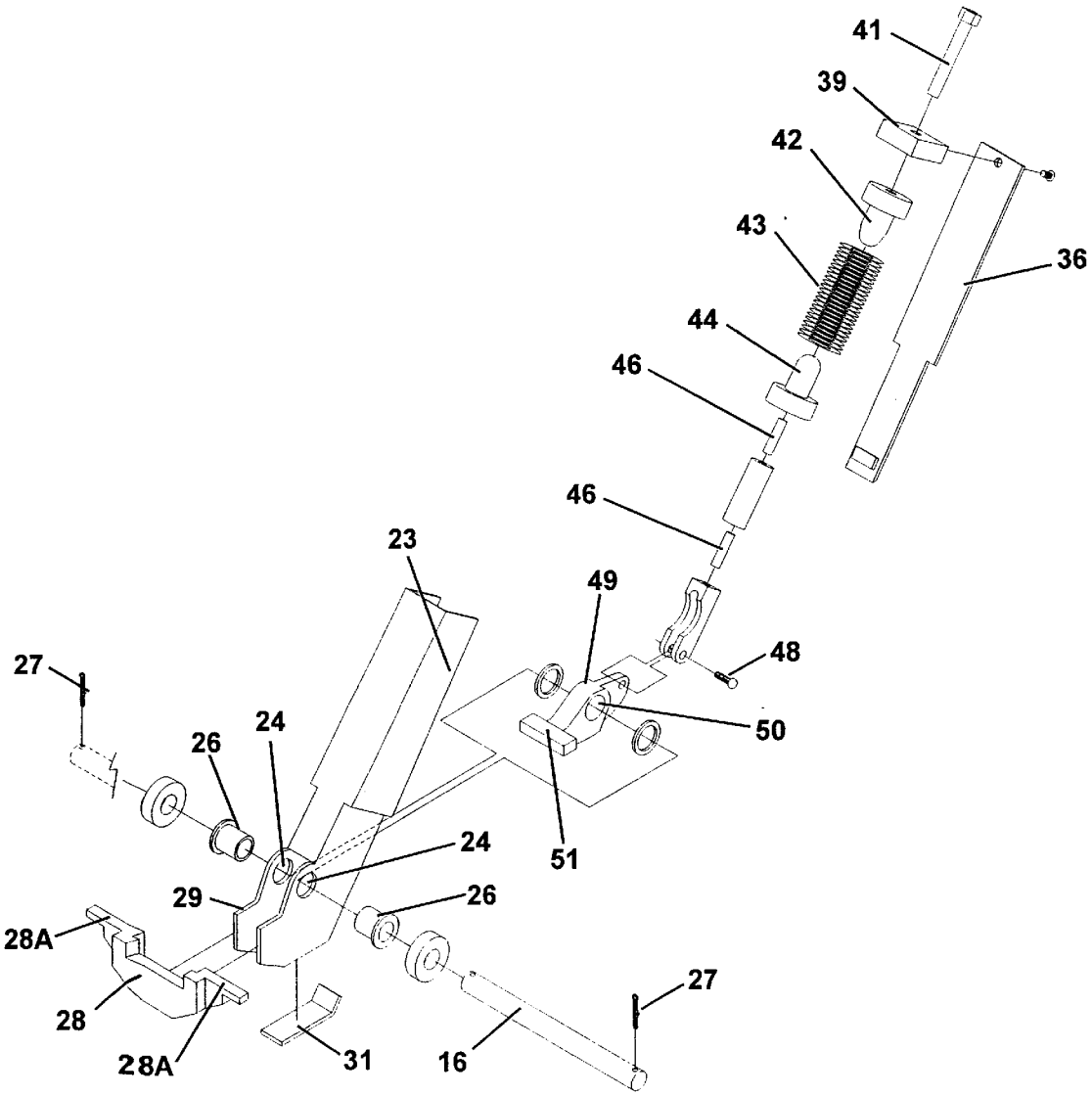
FIG. 6 is an exploded view thereof.
Figure 7:
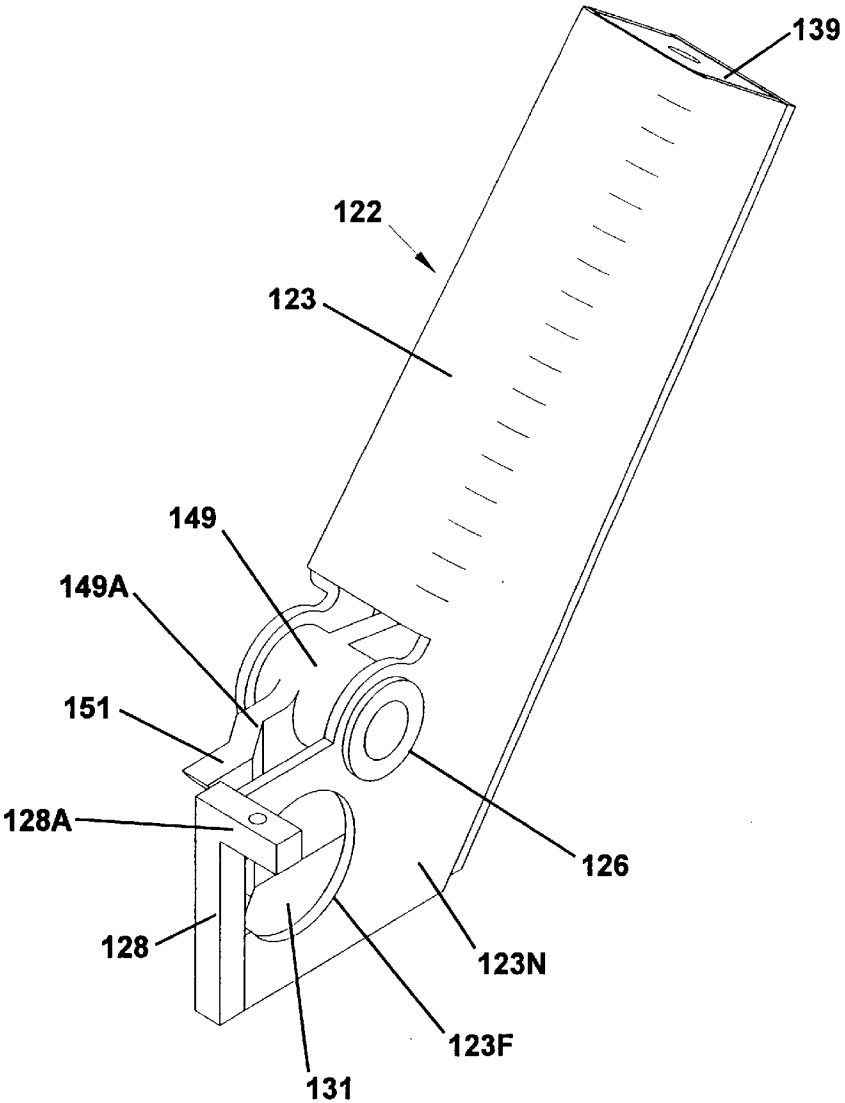
FIG. 7 is a pictorial view of an alternate embodiment of the invention.
Figure 8:
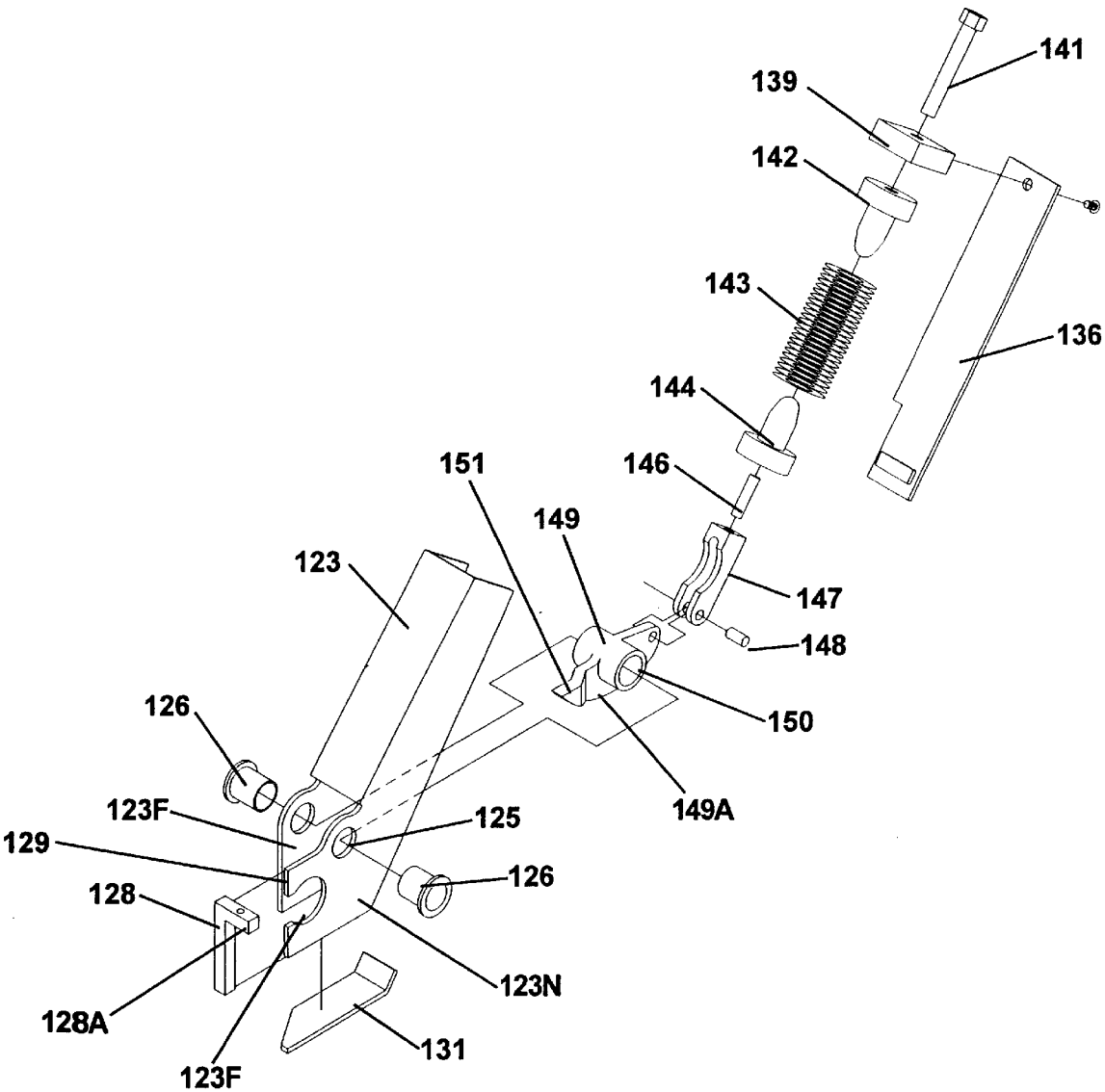
FIG. 8 is an exploded view of the alternate embodiment.
Figure 9:
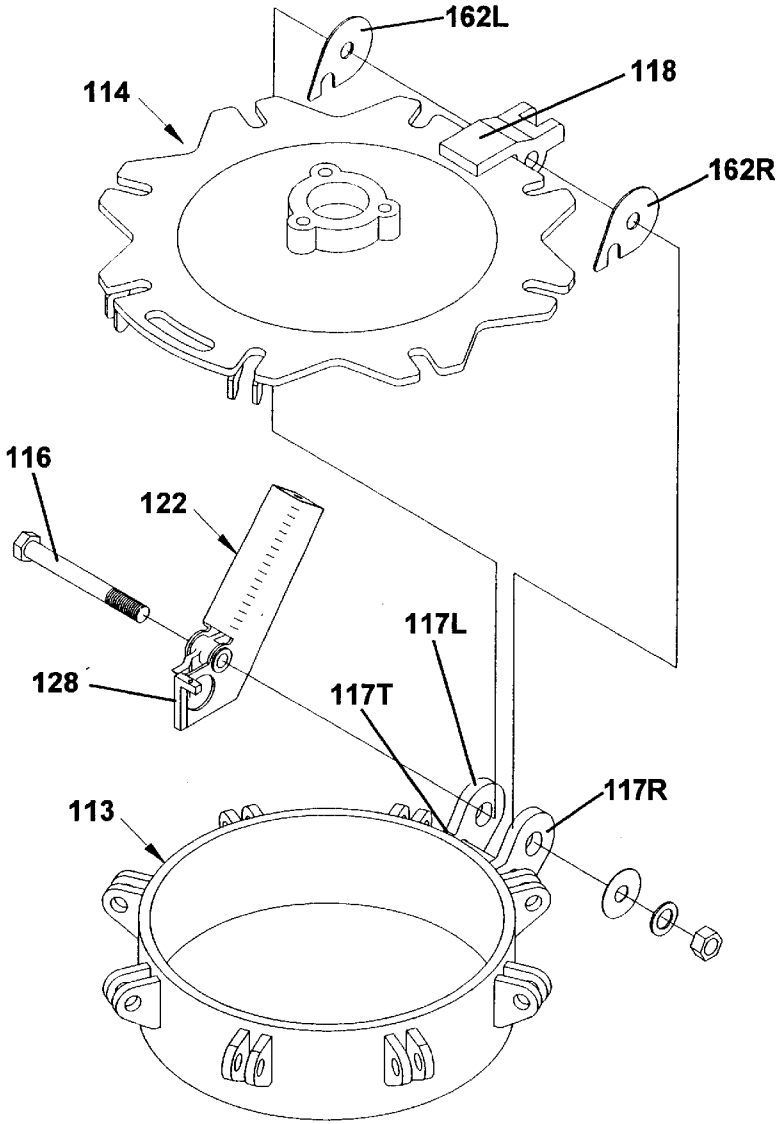
FIG. 9 is an exploded view of a manway/lid assembly with the lid lifter assembly of the alternate embodiment.

The manway/lid assembly of FIGS. 9–12 is constructed somewhat different from that shown in FIGS. 1, 3 and 4, but the installation of the complete lift assembly 122 is just as easy for this embodiment as for the first. The cam 149 will already be pivotally mounted on bushings 126 received in apertures 125 in the U-channel 123. The rest of the components 139–148 will be in place in the channel 123. Then it is only necessary to remove the hinge pin 116, install it through the bushings 126 and then through the manway bracket 117L, washer 162L, hinge arm 118, washer 162R, bracket 117R, the flat washer, lock washer, and install the nut on the hinge pin bolt. The lid stop rod 163 can remain in place during this entire procedure. There is usually a weld at the outside face of each of the hinge brackets 117L and 117R where the stop rod had been welded to the bracket. The notch 123F in the front of wall 123N is large enough to accommodate the bulge of the weld, and still permit the wall 123N to be placed snug against the outside face of the bracket 117L without interference. In cases where the manway lid will accommodate the center-mounted lift assembly of FIGS. 1–6, and if the manway happens to have a stop rod such as 163 in FIG. 11, the stop rod can be cut out and discarded to admit the stop plate 28 and front end of the assist assembly to place it against the manway wall 13. In that case, if the user desires to open the lid entirely, it can be rested on the top of the U-channel in the absence of the stop rod.

The present invention will work regardless of whether the hole in the hinge arm 18 or 118 is round, or elongated to accommodate some vertical travel while being clamped down closed as standard hold-down clamps (not shown) are applied. Additional washers such as 162L can be used to avoid lateral tilting of the lid by the outboard-mounted lift assembly of FIGS. 7–12 if the spacing between the hinge arm and brackets 117L and 117R of the manway assembly is excessive.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A chamber closure assembly, including:

a manway;

a lid pivotally mounted to the manway by a hinge pin; and a lid lifter assembly, including:

a mount having a first locating surface to be mounted on the hinge pin, and the mount having a second locating surface to bear on an outer peripheral surface of the manway without being securely affixed thereto for locating the mount relative to the manway;

a cam member having a first surface to be mounted on the hinge pin, whereby the cam member is rockable on the hinge pin; and the cam member having a second surface to bear on a outer peripheral surface of the lid without being securely affixed thereto; and the cam member having a third surface to receive and bear against a biasing device;

said biasing device engaging the mount and the third surface of the cam member to bias the cam member in a direction to urge the second surface of the cam member to bear on said outer peripheral surface of the lid.

2. The assembly of claim 1 and wherein:

the first surface of the cam member is located between the second and third surfaces thereof, whereby the cam member is adapted to operate as a lever.

3. The assembly of claim 1 and wherein:

the third surface of the cam member is in an aperture in the cam member; and the biasing device comprises a spring having one end restrained by the mount and having the other end restrained by a connector engaging the aperture in the cam member.

4. The assembly of claim 3 and wherein the biasing device further comprises:

a spring top retainer engaging said one end of the spring;

an adjustment screw engaging a portion of the mount and threadedly connected to one of the mount and the top retainer and operable against the other of the mount and the top retainer to move the one end of the spring relative to the mount;

a spring bottom retainer engaging said other end of the spring; and a yoke;

said bottom retainer bearing on the yoke; and said connector being a pin received in the aperture in the cam and in the yoke and pivotally mounting the biasing device to the cam member.

5. A chamber closure assembly comprising:

a manway; the manway having arms projecting outward, at least two of said arms having hinge pin receiver apertures;

a manway lid having at least one arm projecting outward and having a hinge pin receiver aperture, the lid being movable from a first position covering the manway to a second position uncovering the manway for access through the manway to a chamber;

a hinge pin received through said hinge pin receiver apertures and pivotally connecting the lid to the manway whereby the lid is pivotally movable from the first position to the second position;

a lid lifter mount located on the hinge pin;

a biasing device engaging the mount; and a cam member having a first surface mounted on the hinge pin, whereby the cam member is rockable on the hinge pin; and the cam member having a second surface bearing on an outer peripheral surface of the lid without being securely affixed thereto; and the cam member having a third surface bearing against said biasing device whereby the biasing device urges the second surface bearing on said outer peripheral surface of the lid in a direction urging the lid toward the second position.

6. The assembly of claim 5 and wherein:

the first surface is located between the second and third surfaces, whereby the cam member is operable as a lever.

7. The assembly of claim 5 and wherein the biasing device further comprises:

a spring having one end restrained by the lid lifter mount and having the other end restrained by the cam member.

8. The assembly of claim 7 and wherein:

the lid lifter mount is pivotable on the hinge pin and has a locating surface engaging an outer peripheral surface of the manway to limit pivoting of the mount on the hinge pin.

9. A chamber closure assembly comprising:

a manway; the manway having at least one hinge pin mounting arm projecting outward, said at least one hinge pin mounting arm having a hinge pin receiver aperture;

a manway lid having at least one arm projecting outward and having a hinge pin receiver aperture, the lid being movable from a first position covering the manway to a second position uncovering the manway for access through the manway to a chamber;

a hinge pin having an axis and received through said hinge pin receiver apertures and pivotally connecting the lid to the manway whereby the lid is pivotally movable from the first position to the second position;

a lever pivotally mounted to the hinge pin and having a first portion on one side of the hinge axis and engaged with the lid, and having a second portion on the opposite side of the hinge axis;

a lever loading device engaged with the second portion of the lever;

the lever loading device having a first portion mounted on the hinge pin, and a second portion engaged with an outer peripheral surface of the manway without being securely affixed thereto to limit pivoting of the loading device on the hinge pin.

10. The assembly of claim 9 and wherein the lever loading device includes:

a stop wall remote from the hinge axis; and a spring compressed between the second portion of the lever and the stop wall.

11. The assembly of claim 10 and wherein the lever loading device further includes:

a yoke having one end pinned to the lever and having another end seating the spring;

a stop surface engaged with the manway to cooperate with the hinge pin and locate the loading device relative to the manway; and a bar on the lever and engaged with an outer peripheral surface of the lid to enable the bar to urge the lid toward the second position.

12. The lifter assembly of claim 11 and further comprising:

an adjuster on the spring and operable to adjust the amount of force applied by the spring to cause the lever to urge the lid toward the second position.

13. The lifter assembly of claim 12 and wherein:

the loading device has an aperture receiving the hinge pin through said aperture; and the lever has an aperture receiving the hinge pin through it for rocking on the hinge pin in response to opening and closing of the lid.

14. The lifter assembly of claim 9 and wherein:

the lever loading device includes a housing having said first and second portions therein; and the manway surface engaged by the second portion is a hinge bracket receiving the hinge pin through said hinge bracket.

15. The assembly of claim 9 wherein:

the lever is mounted beside the hinge arm.

16. The assembly of claim 9 wherein:

the lid includes a pair of said at least one arm; and the lever is located between the pair of hinge arms.

17. A device for lifting a manway lid, the lid being pivotally coupled to a manway by a hinge pin to permit the lid to pivot between a closed position and an open position, the device comprising:

a mount coupled to the manway by the hinge pin, said mount including a stop member adapted to bear against an outer peripheral surface of the manway without being securely affixed thereto to prevent said mount from pivoting relative to the manway;

a cam member pivotally mounted to the manway by the hinge pin; and a biasing member disposed between said mount and said cam member, said biasing member urging said cam member to pivot about the hinge pin to cause said cam member to bear against an outer peripheral surface of the lid to pivot the lid toward the open position.

18. The device of claim 17, wherein said cam member is a lever including a first portion disposed on one side of the hinge pin and a second portion disposed on an opposite side of the hinge pin, said biasing member engaging said first portion of said lever to pivot said lever about the hinge pin and engage said second portion of said lever against said outer surface of the lid to bias the lid toward the open position.

19. The device of claim 17, wherein said mount includes a housing, said biasing member being disposed within said housing.

20. The device of claim 19, wherein said biasing member comprising a coil spring.

21. The device of claim 19, wherein said cam member is at least partially disposed within said housing.

22. The device of claim 19, wherein said housing includes a yoke portion, said yoke portion including a pair of opposing walls with said cam member being disposed between said pair of walls, the hinge pin extending through apertures in said pair of walls and said cam member.

23. The device of claim 19, wherein said housing is a weldment.

24. The device of claim 17, wherein the biasing device comprises:

a first spring retainer coupled to said mount;

a second spring retainer coupled to said first portion of said lever; and a spring disposed between and retained by said first and second spring retainers.

25. The device of claim 24, wherein said spring is a coil spring defining a hollow interior, each of said first and second spring retainers being at least partially disposed within said hollow interior of said coil spring.

26. The device of claim 24, wherein said biasing device further comprises an adjustment screw threadingly engaging a threaded aperture defined through an end wall of said mount and being connected to said first spring retainer, said adjustment screw being threaded through said threaded aperture to adjust tension in said spring.

27. The device of claim 17, wherein said cam member bears against an outer peripheral surface of the lid to pivot the lid toward the open position.

* * * * *

UNITED STATES PATENT AND TRADEMARK OFFICE

CERTIFICATE OF CORRECTION

PATENT NO. : 6,446,307 B2
DATED : September 10, 2002
INVENTOR(S) : Larry C. Wilkins It is certified that error appears in the above-identified patent and that said Letters Patent is hereby corrected as shown below:

Column 4,
Line 64, please change “including” to -- comprising --.

Column 5,
Line 48, please change “manway;” to -- manway, --.

Column 8,
Line 8, please change “comprising” to -- comprises --.

Signed and Sealed this

Eleventh Day of February, 2003

JAMES E. ROGAN
*Director of the United States Patent and Trademark Office*